US010180267B2

(12) United States Patent
Bober

(10) Patent No.: US 10,180,267 B2
(45) Date of Patent: Jan. 15, 2019

(54) APPARATUS FOR SUPPORTING EXPANSION TANK

(71) Applicant: James T. Bober, Pittsboro, NC (US)

(72) Inventor: James T. Bober, Pittsboro, NC (US)

( * ) Notice: Subject to any disclaimer, the term of this patent is extended or adjusted under 35 U.S.C. 154(b) by 0 days.

(21) Appl. No.: 15/425,285

(22) Filed: Feb. 6, 2017

(65) Prior Publication Data

US 2017/0276405 A1 Sep. 28, 2017

Related U.S. Application Data

(60) Provisional application No. 62/455,089, filed on Feb. 6, 2017, provisional application No. 62/291,630, filed on Feb. 5, 2016.

(51) Int. Cl.

| | |
|---|---|
| ***A47G 23/02*** | (2006.01) |
| ***F24H 9/06*** | (2006.01) |
| ***F24H 1/18*** | (2006.01) |

(52) U.S. Cl.

CPC ..... *F24H 9/06* (2013.01); *F24H 1/188* (2013.01)

(58) Field of Classification Search

CPC .. F24H 9/06; F24H 1/188; F24H 1/18; F16M 13/02; F24D 3/1008; F24C 3/14

USPC .... 248/105, 106, 146, 152, 154, 207, 311.3, 248/312, 505; 126/362; 137/337; 220/529

See application file for complete search history.

(56) References Cited

U.S. PATENT DOCUMENTS

| | | | | |
|---|---|---|---|---|
| 1,022,409 | A | 4/1912 | Foster | |
| 2,344,556 | A * | 3/1944 | Manley | B67D 1/0456 119/71 |
| 2,615,238 | A * | 10/1952 | Highwood | F17C 13/084 248/146 |
| 2,686,032 | A | 8/1954 | Thorson | |
| 2,876,925 | A | 3/1959 | Wall et al. | |
| 2,883,139 | A | 4/1959 | Dobkin | |
| 4,071,976 | A | 2/1978 | Chernewski | |
| 4,134,566 | A * | 1/1979 | Spitzack | F16M 13/02 248/309.1 |
| 4,213,592 | A | 7/1980 | Lingenfelser | |
| 4,254,926 | A * | 3/1981 | Reeberg | F16N 13/08 248/152 |
| 4,379,541 | A | 4/1983 | Harkness | |
| 4,441,684 | A | 4/1984 | Credle | |
| 5,100,007 | A | 3/1992 | Espasandin et al. | |

(Continued)

FOREIGN PATENT DOCUMENTS

| | | |
|---|---|---|
| CN | 201327228 Y | 10/2009 |
| FR | 2825459 A1 | 12/2002 |

*Primary Examiner* — Gwendolyn W Baxter

(74) *Attorney, Agent, or Firm* — Michael G. Johnston; Moore & Van Allen PLLC

(57) ABSTRACT

An apparatus for supporting s a thermal or hydronic expansion tank relative to a hot water heater comprises a rigid bracket adapted to be secured to the tank and to the hot water heater. The bracket provides support for the tank adjacent to the pipe nipple. The tank and the bracket are interconnected for securing the tank to the bracket. In one aspect, the bracket comprises a base, and an end wall at each end of the base. The end walls are adapted for engaging and supporting the tank, wherein one of the end walls engages the tank adjacent the pipe nipple and the other of the end walls engages the tank past the midpoint of the length of the tank from the base.

13 Claims, 10 Drawing Sheets

(56) References Cited

U.S. PATENT DOCUMENTS

| | | | | |
|---|---|---|---|---|
| 7,918,204 | B2 | 4/2011 | Gignac et al. | |
| D689,980 | S | 9/2013 | Ziaylek et al. | |
| 2010/0300376 | A1* | 12/2010 | Nalini | F24H 9/06 122/13.3 |
| 2016/0047571 | A1* | 2/2016 | Jones | F24H 9/06 248/313 |
| 2017/0159877 | A1* | 6/2017 | Brown | F16M 13/02 |

* cited by examiner

APPARATUS FOR SUPPORTING EXPANSION TANK

CROSS-REFERENCES

This application is related to U.S. provisional application Nos. 62/291,630, filed Feb. 5, 2016, and 62/455,089, filed Feb. 6, 2017, entitled "BRACKET FOR EXPANSION TANK", naming James T. Bober as the inventor. The contents of the provisional applications are incorporated herein by reference in their entirety, and the benefit of the filing dates of the provisional applications is hereby claimed for all purposes that are legally served by such claim for the benefit of the filing date.

BACKGROUND

An apparatus is provided for supporting an expansion tank and, more particularly, a bracket is provided for attachment between an expansion tank and an associated hot water heater or adjacent structure.

Expansion tanks are used in domestic water systems particularly to protect hydronic or thermal (hot water) heating systems. An expansion tank is required when the water system includes a backflow prevention device such as a check valve, a pressure reducing valve, or other means of reduced pressure backflow protection. The tank is a manufactured cylindrical vessel normally possessing slightly rounded ends and typically made of steel or other rigid material, which conventionally may be rated to take an internal pressure of up to 200 pounds per square inch (psi). The expansion may be provided with a pipe nipple usually at the center of one end for connection to the plumbing, thereby permitting water and any entrained air to enter and exit the tank. The expansion tank houses an internal expandable rubber bladder to separate the water from a cushion of pressurized air within the tank. An air valve often placed at the opposite end of the tank permits a plumber or installer to adjust the air pressure behind the bladder to correspond as needed to the normal system water pressure. In the absence of the air valve, a predetermined back pressure is applied to the bladder during manufacture.

Thermal expansion tanks extend the life of water heaters and similar equipment. Expansion tanks may also be used to eliminate the phenomenon known in the trade as "water hammer", caused when a plumbing system vibrates and emits loud knocking noises due to water surging against trapped air pockets in the piping. They may heat and cool periodically and may change weight by virtue of the varying contents during intermittent usage. Because the tank partially fills with water during use, a typical tank used in the home may weigh up to ten pounds or more. In commercial installations, an expansion tank may weigh up to 20 pounds or more during use.

Expansion tanks may be installed in either a vertical, horizontal or occasionally other orientation. Since expansion tanks can fail over time and may need to be changed periodically, or the connections to the tank may need to be replaced, a simple and quick means of access and replacement is desired.

The expansion tank, as well as the piping to which the tank is connected, may expand and contract very slightly with temperature changes. Means for supporting the tank must allow for such very slight expansion and contraction without permitting major disruptive movement. Vibration should also be minimized as it could be deleterious to the piping system leading to premature failure. Vertically mounted tanks should be well secured to prevent tipping as the internal weight changes.

According to manufacturers' instructions and official plumbing requirements, a thermal expansion tank must have an external means of support other than the piping. This is particularly necessary when piping other than hard metal piping is used. Currently there are no known official standard prescribed ways of furnishing such means. As commercial piping itself has evolved over time from hard metal piping to more modern, less expensive systems utilizing flexible plastic piping, the means of support for the expansion tank becomes even more critical to prevent the tank from moving significantly, tilting, twisting or becoming disconnected during use due to flexing of the piping and filling and emptying of the tank as well as possible disruptions in the surrounding area. Custom arrangements whereby hard piping must unavoidably be used to support the tank in the vicinity of the water heater, followed by flexible plastic piping elsewhere in the system, become more expensive, time-consuming and cumbersome to install.

Some custom support means currently employed in the art for expansion tanks include use of various types of metal or plastic strapping to joists, rafters, columns, studs, pipes, posts, or similar structural means within the building structure, wiring the tank to such structural means, cradling the tank between parallel or other pieces of lumber or similar support means that are custom-installed on site, building a shelf under the expansion tank, and similar miscellaneous means that may vary with the job situation and the individual experiences of the plumber or installer. All such custom on-site installation methods are time-consuming and therefore costly, can change with conditions encountered on the individual job and location where the tank is being placed, and may not pass official inspection.

Plumbing codes prevent use of support means that would violate the integrity of the manufactured tank itself such as welding or brazing a piece of metal to the tank, fastening a bracket to the tank by means of screws or fasteners that would penetrate the wall of the tank, or similar such means that may lead to tank failure and subsequent safety hazard or damage to the surroundings. Since the tank is usually coated with a surface protection means such as paint to prevent external corrosion, thereby extending the life of the tank, it is undesirable to employ a support means that would damage that surface protection.

Adhesive means such as gluing or duct-taping the tank to a building structural member or other point are generally impractical and would not survive over an extended period of time, due to repeated weight changes plus slight expansion and contraction with thermal changes of the tank as well as aging of the adhesive means, nor pass official inspection.

Finally, tanks that are installed on a nearby wall or other surrounding structure should have some sort of separate overflow or rupture protection to protect the surroundings against flooding should failure occur, often mandated by inspectors, architects or official code. Tanks installed on the water heater itself can benefit from use of the same drainage tray typically used on the floor under water heaters and increasingly required in modern installations, including where such heaters are installed on upper floors or in water-sensitive areas of a building. Similarly, any alarm system installed to warn of failure of the water heater could also detect any problem with the expansion tank, rather than needing a second system.

For the foregoing reasons there is a need for a simple, compact and inexpensive apparatus to affix a thermal expansion tank directly to a moveable free-standing structure, such as a residential, commercial or industrial hot water heater. The expansion tank may be installed above the heater in a vertical, horizontal, or other orientation such that any means that has been installed to protect the surroundings from flooding and water damage due to failure of the heater, such as an overflow drainage tray installed under the heater or a flood alarm system, can simultaneously protect against any failure of the expansion tank without requiring separate flooding protection as would be needed for tanks located remotely from the water heater, including those mounted on a nearby building structural member. The apparatus for affixing the expansion tank should simplify and require minimal use of time to install the apparatus, minimize the space required for the apparatus, not damage the integrity or surface coating of the tank while making it integral to the hot water heater, minimize the length of piping attaching the tank to the heater, and meet all official plumbing requirements for installation of such a tank. Since the expansion tank will change weight during use, the apparatus should permit the tank to change weight or expand and contract slightly in normal repetitive usage without detaching itself from the apparatus holding it, or causing other damage to the plumbing system or the surroundings. Stress and strain on the piping system connected to the tank should also be minimized by not forcing the piping to bear the weight of the tank and its contents, thereby allowing the use of modern flexible plastic piping if desired rather than metal piping which is more expensive and more difficult to assemble, and to prevent said piping from detaching itself from the tank or suffering breakage or leakage due to such stress and strain. Finally, the new supporting apparatus should allow the tank to be easily removed from such apparatus for replacement when the tank fails or is due to fail because of age or continued use, and to easily reinstall a replacement tank without unnecessary dismantlement of the supporting apparatus or time-consuming cleanup or refurbishing of the apparatus.

SUMMARY

An apparatus is provided for supporting a thermal or hydronic expansion tank relative to a hot water heater. The tank includes a pipe nipple for fluid connection to a water piping system. The tank supporting apparatus comprises a rigid bracket adapted to be secured to the tank and to the hot water heater. The bracket providing support for the tank adjacent to the pipe nipple. Means interconnecting the tank and the bracket for securing the tank to the bracket.

In one aspect, the bracket comprises a base, and an end wall at each end of the base. The end walls are adapted for engaging and supporting the tank, wherein one of the end walls engages the tank adjacent the pipe nipple and the other of the end walls engages the tank past the midpoint of the length of the tank from the base.

BRIEF DESCRIPTION OF THE DRAWINGS

For a more complete understanding of the apparatus for supporting an expansion tank, reference should now be had to the embodiments shown in the accompanying drawings and described below. In the drawings.

DESCRIPTION

Certain terminology is used herein for convenience only and is not to be taken as a limiting. For example, words such as "upper," "lower," "left," "right," "horizontal," "vertical," "upward," "downward," "top" and "bottom" merely describe the configurations shown in the FIGs. Indeed, the components may be oriented in any direction and the terminology, therefore, should be understood as encompassing such variations unless specified otherwise. The words "interior" and "exterior" refer to directions toward and away from, respectively, the geometric center of the core and designated parts thereof. The terminology includes the words specifically mentioned above, derivatives thereof and words of similar import.

A supporting apparatus for an expansion tank is described herein and comprises a universal bracket member suitable for supporting the thermal expansion tank in compliance with the requirements of official plumbing codes and inspections. The supporting apparatus meets all of the objectives listed above and eliminates the need to custom-construct a support means on site for each individual situation or mandating that the tank be fastened to a wall or other remote fixed building structural element with no alternative option. It is understood, however, that the supporting apparatus does not preclude such remote mounting possibility should a particular individual circumstance such as a space restriction prevent the thermal expansion tank from being directly mounted on the hot water heater.

Figure 1:
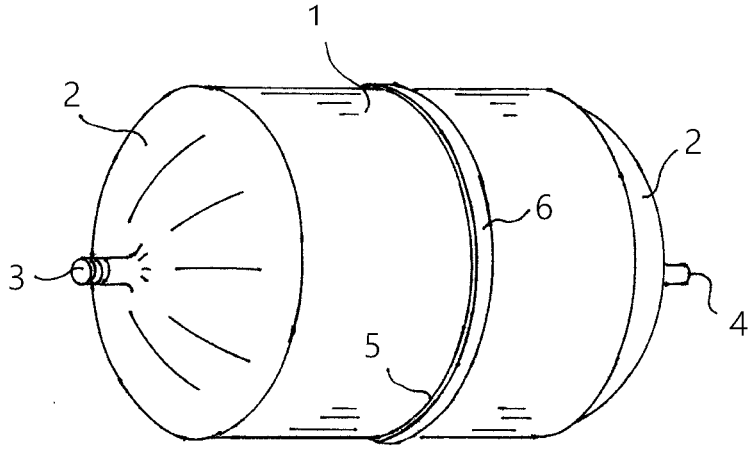
FIG. 1 is a perspective view of a thermal expansion tank.

Referring now to the drawings, wherein like reference numerals designate corresponding or similar elements throughout the several views, FIG. 1 illustrates an external side view of a typical commercially available thermal expansion tank of approximately 2 gallons capacity, having a maximum working pressure of 150 psi, maximum working temperature of 200° F., pre-charge pressure of 40 psi, and test pressure of 100 psig. The expansion tank comprise a cylindrical metal tank 1 having slightly rounded ends 2 and including a threaded pipe nipple 3 at the center of one end, an air valve 4 at the center of the opposite end, a circumferential weld seam 5, and a peripheral banding area of slightly reduced circumference 6 whereby the tank may be externally banded or fastened to a building structural element by a strapping or wiring means. It is understood by those skilled in the art that various alternative configurations by different manufacturers, including different operating characteristics for different load situations, different locations for pipe nipple 3 and air valve 4, or the complete absence of air valve 4, weld seam 5, or peripheral banding area 6 are possible.

Figure 2:
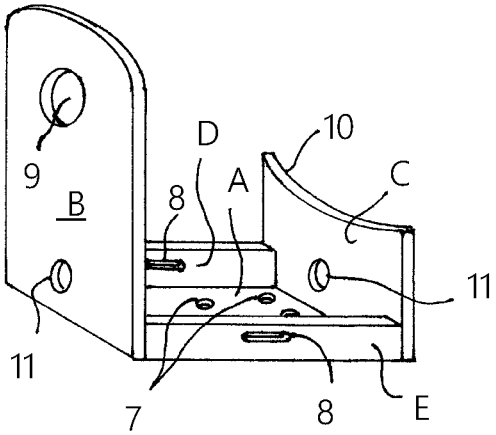
FIG. 2 is a perspective view of an embodiment of a bracket for use in supporting the thermal expansion tank as shown in FIG. 1.

One embodiment of the supporting apparatus is shown in FIG. 2. This embodiment comprises a bracket defining an open box constructed of metal or similar rigid material. For example, the bracket may be fabricated from 16-gauge steel by conventional metal forming techniques, including employing a high-pressure water jet to cut the steel thereby avoiding the need for subsequent deburring or polishing of the cut edges.

Surface A of the bracket is a base support surface containing holes 7 through which the bracket may be fastened directly to the top or side of a hot water heater or other free-standing structure. Alternatively, if desired, the bracket may be fixed to a building structural member by use of standard fastener means such as screws, bolts, nails or the like. Surface B extends from one end of Surface A at right angles to it for supporting the front end of an expansion tank. Surface C is located at the other end of Surface A and also extends at right angles to Surface A for supporting the rear end of the expansion tank.

Surfaces D and E are optional sidewalls extending at right angles to Surface A and perpendicular to Surfaces B and C. Preferably, the sidewalls are sufficiently distant from the expansion tank to permit insulation to be wrapped or sprayed around the tank. The sidewalls may contain slots or holes 8 through which a flexible securing means, as more fully described hereinafter, is disposed and subsequently fastened about the expansion tank to secure it to the bracket.

As shown in FIG. 2, Surface B terminates in an end defining a hole 9 which is configured to loosely receive and support the pipe nipple 3 at the front end of the expansion tank. Surface C terminates in a segment of a circle 10 that coincides with the outer circumference of the tank to be suspended. Surfaces B and C may also include additional holes, slots or similar openings 11 on a concentric axis thereby enabling the bracket to be suspended vertically, as later described herein. Surfaces B and C may also optionally have other holes (not shown) that permit the bracket to be affixed at one or both ends to one or more structural members of the building or other fixed point, by conventional fasteners such as screws, nails or the like.

Figure 3:
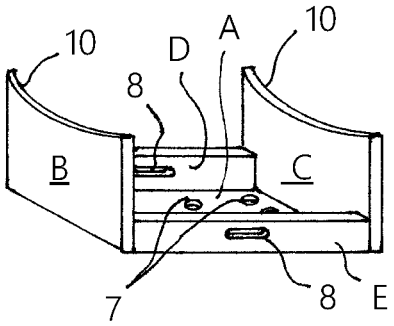
FIG. 3 is a perspective view of another embodiment of a bracket for use in supporting the thermal expansion tank as shown in FIG. 1.

In yet another embodiment of the support means as shown in FIG. 3, a simplified bracket is intended for situations where the thermal expansion tank 1 is to be mounted horizontally or at a slight angle but not vertically. Surface B and Surface C terminate in ends 10 that are both curved segments of a circle which coincide with the outer circumference of the tank 1 at their point of contact with the tank.

Figure 4:
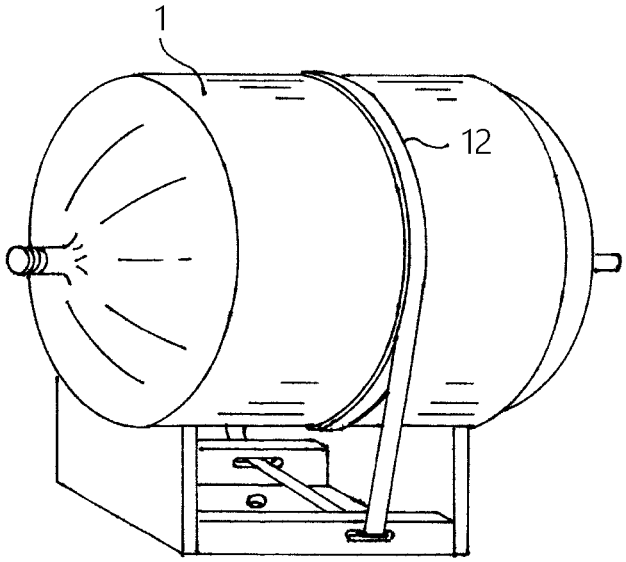
FIG. 4 is a perspective view of the bracket shown in FIG. 3 supporting the thermal expansion tank as shown in FIG. 1 secured to the bracket.

FIG. 4 shows an overall view of the support means described in FIG. 3 in contact with a typical tank 1, including the pipe nipple 3 and air valve 4, where the tank is positioned horizontally, and includes one example of a securing means 12. The securing means 12 comprises one or more flexible straps, bands, wires, polymeric hook-and-fabric banding assembly (e.g., Velcro), ropes or cables of metal, plastic, fiber or other flexible means.

Figure 5:
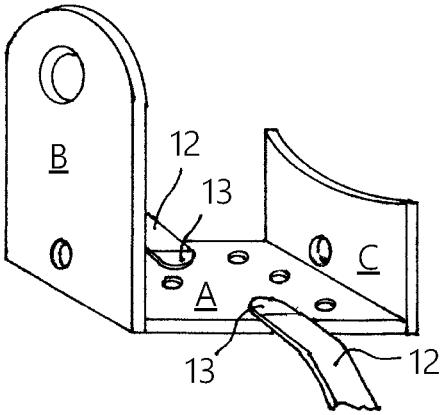
FIG. 5 is a perspective view of a third embodiment of a bracket for use in supporting the thermal expansion tank as shown in FIG. 1.

Optionally one or more ends of securing means 12 may be pre-attached to Surface A or other point on the bracket during manufacture by means comprising one or more rivets, adhesive, spot welding, crimping, stitching or other similar means commonly known to the art, to allow rapid installation of the entire assembly without needing to separately manipulate said securing means 12 on site as loose individual component(s) during such installation, with only its(their) free end(s) subsequently needing to be fastened with a clip, clamp or other means known to the art either to the opposite side of the bracket, or to each other if securing means 12 is composed of two components, as that particular manufactured version of the bracket dictates. An example of such pre-attached securing means is shown in FIG. 5, wherein the point of attachment 13 to Surface A.

Figure 6:
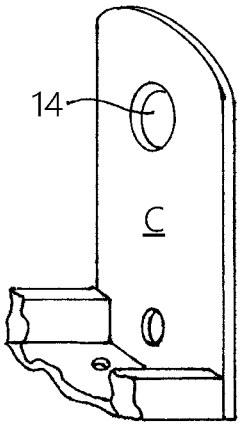
FIG. 6 is a partial perspective view of an embodiment of one end of the bracket as shown in FIG. 2 or 3.

In another embodiment shown in FIG. 6, Surface C constitutes a plate that partially or fully encloses the rear of the tank to be suspended and incorporates a hole 14 for the air valve 4.

In another alternative (not shown), Surfaces B and C may also be prepared as end plates that extend well beyond the centerline of the tank and contain holes or slots through which the pipe nipple 3 and air valve 4, respectively, can simultaneously extend. In this case, while Surface B remains rigid, Surface C has been manufactured to be slightly flexible, having sufficient spring tension to spring back into place after being temporarily bent. During installation, after the bracket has been affixed to the supporting surface, pipe nipple 3 is placed through hole 9 in Surface B while Surface C is bent away slightly to allow clearance for air valve 4, thus permitting the tank to enter the bracket. Upon release, Surface C returns to its normal position.

Figure 7:
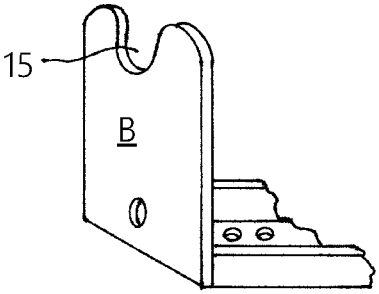
FIG. 7 is a partial perspective view of another embodiment of an end of the bracket as shown in FIG. 2 or 3.

Still another optional example of the support means is shown in FIG. 7, where Surface B terminates in an end containing a small semicircular notch 15, rather than the hole 9 previously described in FIG. 2, that supports pipe nipple 3 at the front end of the expansion tank.

Figure 8A:
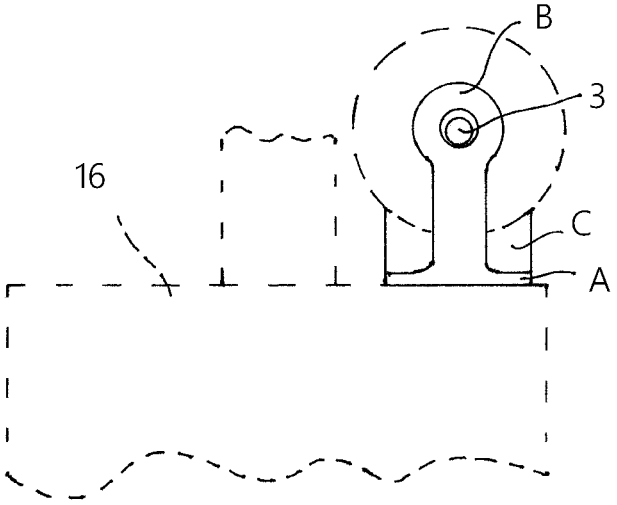
FIG. 8*a* is a side elevation view of a fourth embodiment of a bracket for use in supporting a thermal expansion tank on a hot water tank, both of which are shown in phantom.
Figure 8B:
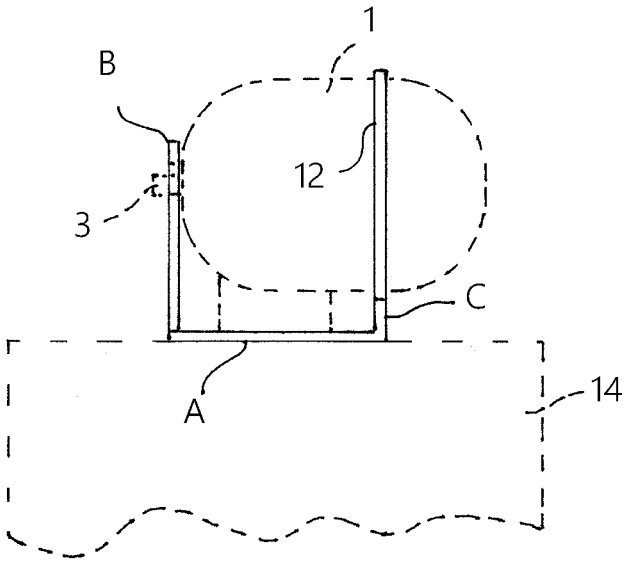
FIG. 8*b* is a front elevation view of the bracket as shown in FIG. 8*a* supporting a thermal expansion tank on a hot water tank, both of which are shown in phantom.
Figure 8C:
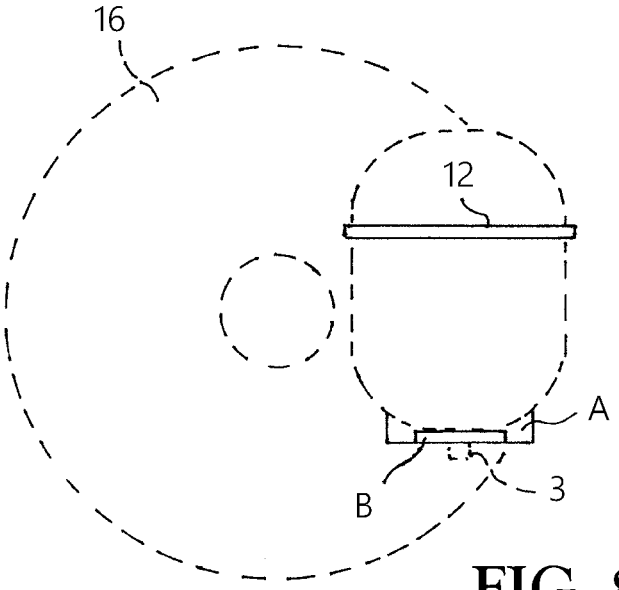
FIG. 8*c* is a top plan view of the bracket as shown in FIG. 8*a* supporting a thermal expansion tank on a hot water tank, both of which are shown in phantom.

A preferred embodiment of the support means in actual use is demonstrated in the three views of FIG. 8, with expansion tank 1 mounted in a horizontal position on top of a water heater 16. Here Surface B is shown as having a somewhat different design than those previously illustrated, being narrower in profile until it joins Surface A at its base. The Surface B may have different optional designs as long as the surface provides adequate support for the tank 1. Pipe nipple 3 is shown to be loosely lying in hole 9. Here securing means 12 is shown fastened to the edge of Surface C rather than to Surface A, which is an alternate option.

As previously mentioned in the discussion of FIG. 2 above, Surfaces B and C may also include holes, slots or similar openings 11 on a concentric axis located away from the tank surface. In yet another manifestation of the support means, these concentric openings 11 allow a vertical member 17 such as rod, or similar member with a different cross-sectional profile such as a channel or the like, to be inserted through the bracket without touching the expansion tank, thereby enabling the bracket to be suspended vertically in mid-air. One preferred embodiment incorporates the use of a stand resting on top of the water heater 16 with an upright member 17; however if the space were insufficient, alternately the bracket could be hung from an overhead structural component of the building or other fixed point by means of an extended vertical member 17 passing through the concentric holes and secured to the fixed point by a nut, collar with set screw, pin or other fastener means 18 commonly known to the art.

Figure 9:
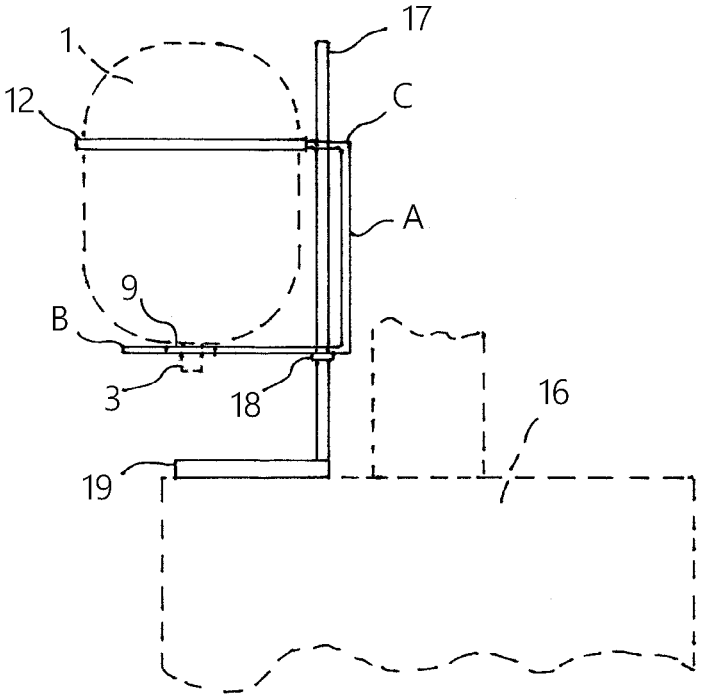
FIG. 9 is a side elevation view of a fifth embodiment of a bracket for use in supporting a thermal expansion tank on a hot water tank, both of which are shown in phantom.

FIG. 9 shows a side view of another preferred embodiment of the supporting apparatus, incorporating a bracket without sidewalls somewhat similar to that illustrated in FIG. 5 but mounted in vertical orientation above water heater 16 on a stand. The baseplate 19 of the stand is attached to the top skin of the water heater using fasteners commonly known to the art. Vertical member 17, in this case a rod, projects upward from the stand. The bracket is suspended on the rod in a vertical position, in this example with pipe nipple 3 pointing downward. A collar with set screw, nut, pin or other fastener means 18 mounted on the rod below the bracket keeps the bracket at a given height. Securing means 12, in this case attached to the edge of Surface C, horizontally encompasses the periphery of tank 1.

Figure 10:
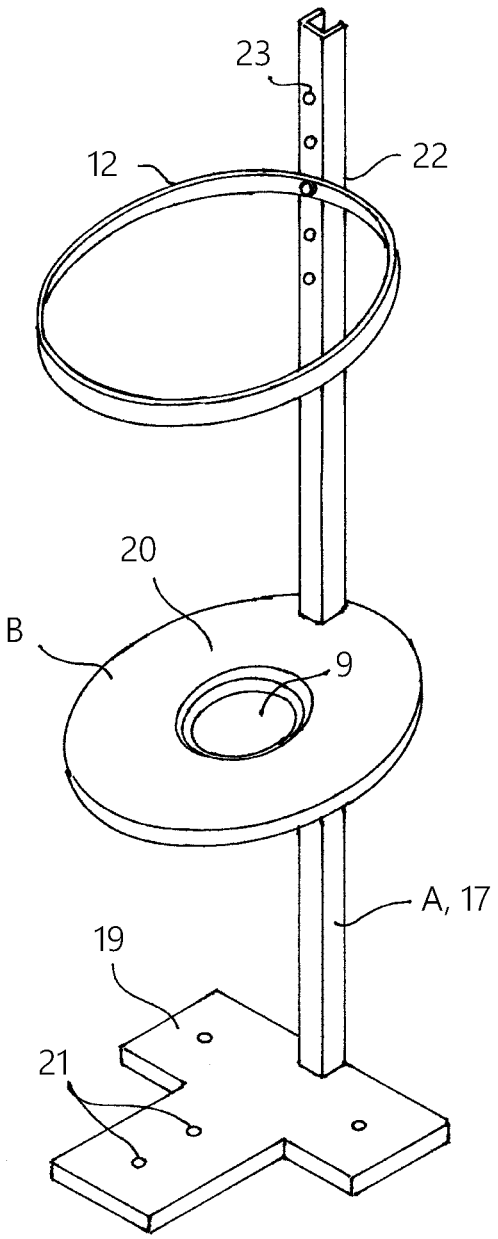
FIG. 10 is a perspective view of a sixth embodiment of a bracket for use in supporting the thermal expansion tank as shown in FIG. 1.
Figure 11A:
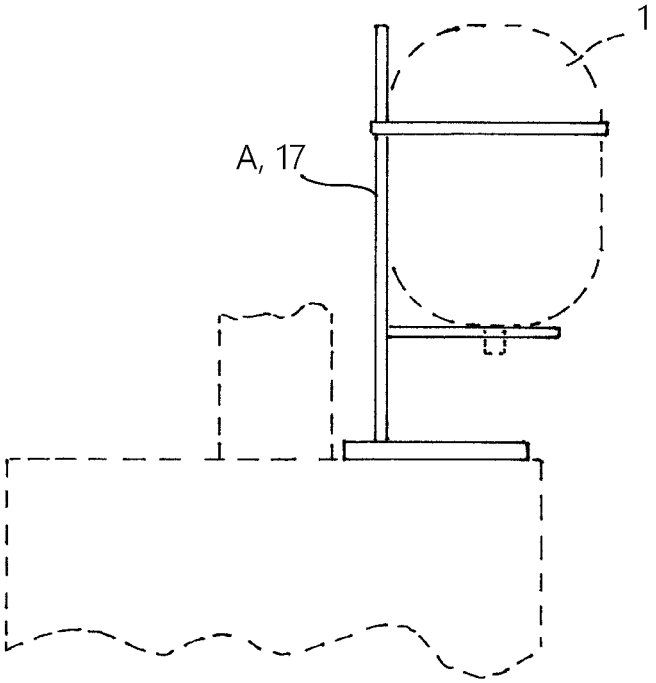
FIG. 11*a* is a side elevation view of the embodiment of the bracket as shown in FIG. 10 supporting a thermal expansion tank and secured to a hot water tank, both of which are shown in phantom.
Figure 11B:
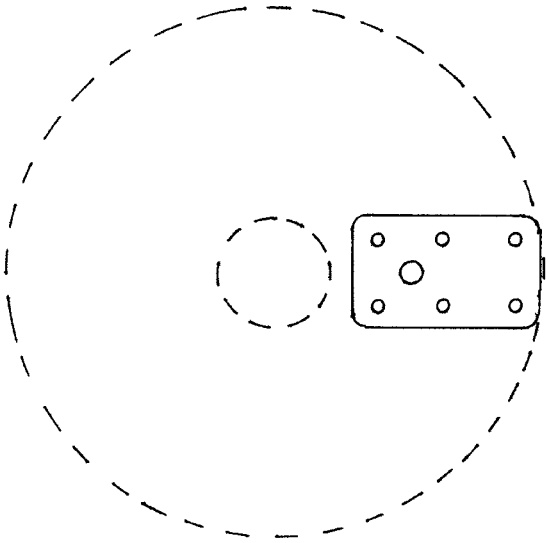
FIG. 11*b* is a top elevation view of the bracket as shown in FIG. 11*a* supporting a thermal expansion tank and secured to a hot water tank, both of which are shown in phantom.
Figure 11C:
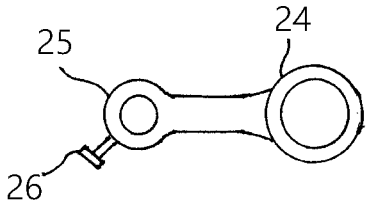
FIG. 11*c* is a plan view of an embodiment of a collar for use with the bracket as shown in FIG. 11*a* in supporting the thermal expansion tank as shown in FIG. 1.
Figure 11D:
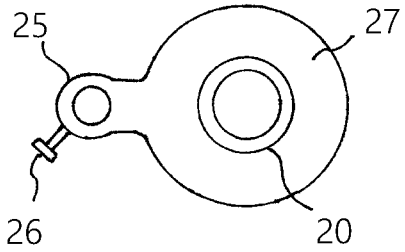
FIG. 11*d* is a plan view of another embodiment of a collar for use with the bracket as shown in FIG. 11*a* in supporting the thermal expansion tank as shown in FIG. 1.
Figure 11E:
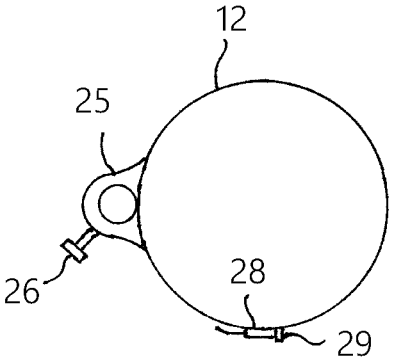
FIG. 11*e* is a plan view of a third embodiment of a collar for use with the bracket as shown in FIG. 11*a* in supporting the thermal expansion tank as shown in FIG. 1.

FIG. 10 shows Surface B having still a different design. In this case the vertical channel 17 acts as Surface A, with circular Surface B attached rigidly to the channel by welding or other permanent or temporary means. If desired the hole 9 may have a slightly chamfered area 20 to better seat the rounded end of the tank. The baseplate 19 of the stand contains holes 21 to fasten the stand to the top of the water heater or to an alternate structure. The securing means 12 is shown as a band that can be adjusted up or down by means of a fastener 22 such as a bolt or similar means, using holes 23 at different vertical positions on the channel or by similar means known to the art.

FIG. 11 shows some alternative options for parts used with the vertical stand previously described. FIG. 11*a* is a side view of the entire assembly, where Surface A in this case is the vertical rod 17, which optionally may be in direct contact with tank 1 as shown or separated from it by a small distance as in prior examples. FIG. 11*b* is a top view and shows a simple design for baseplate 19, for which many other alternate designs are possible, mounted on water heater 16. FIGS. 11*c* and 11*d* are plan views and shows two alternate configurations for Surface B, being Option 1) a ring 24 connected with an extension to collar 25 that slips over rod 17 and is secured in place with a set screw 26 (FIG. 11*c*), or Option 2) a flat plate 27 with optional chamfered area 20 and also secured in position over rod 17 using collar 25 and set screw 26 (FIG. 11*d*). Either option would allow vertical adjustment for various piping configurations, or conversely either could be either permanently fixed in place by welding or similar means known to the art. Again, various other alternate designs are possible. FIG. 11*e* is a plan view and shows an optional upper securing means 12 utilizing a slotted stainless steel band clamp 28 with worm adjusting screw 29 known to the art that is fastened loosely about tank 1 to allow for thermal expansion, the band being attached by spot welding or other means to collar 25 that is again secured in place over rod 17 with set screw 26. As an option, the parts in FIGS. 11*c*-11*e* may be kept in absolute vertical alignment with each other and the tank prevented from twisting by milling a longitudinal groove in the rod to engage the set screws 26.

In yet a further manifestation of the support means, a prototype bracket was prepared by slicing lengthwise a piece of rigid PVC (polyvinyl chloride) pipe to produce a curved section amounting to half the pipe diameter or less. In this first prototype the curved section did not necessarily mate exactly with the periphery of the expansion tank, but merely touched the tank surface with its longitudinal edges. Holes were drilled in positions at or near the center of the section's longitudinal axis to permit it to be secured to a fixed support such as the outer skin of a water heater, or if necessary to a building structural member, with standard fastener means such as screws, nails, bolts or the like. Flexible securing means were run around the outer periphery of the bracket before tightening it to the fixed support, and subsequently fastened around the expansion tank to secure it to the bracket. Alternatively, one or more additional slots or holes could be made a short distance from the edges of the bracket, to permit threading of one or more flexible securing means through these openings and subsequently fastened about the expansion tank to secure it to the bracket.

Figure 12:
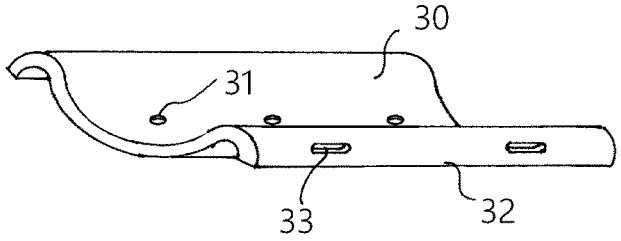
FIG. 12 is a perspective view of a seventh embodiment of a bracket for use in supporting the thermal expansion tank as shown in FIG. 1.

In another embodiment of the support means, FIG. 12 shows another prototype of a similar bracket where, rather than relying on a fixed curvature dictated by cutting into a previously fabricated plastic pipe, a sheet of plastic was heated to its elastic point and molded to a curvature 30 that coincided exactly with the circumference of the tank being supported. Holes 31 were drilled down the center of this first curved surface to mount the bracket to either the top or side of a water heater using fasteners known to the art. Optionally, the edges of this plastic sheet could be bent away from the tank to provide a lip 32 containing openings 33 through which the flexible securing means 12 could be threaded before fastening around the tank to secure it to the bracket.

Figure 13:
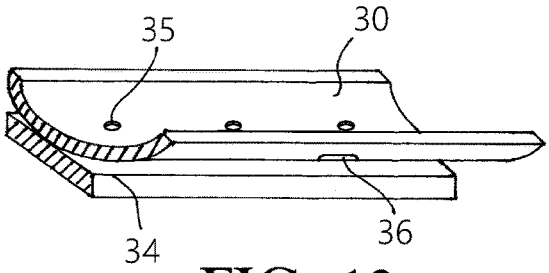
FIG. 13 is a perspective view of an eighth embodiment of a bracket for use in supporting the thermal expansion tank as shown in FIG. 1.

In another version of the bracket, the first curved PVC surface 30 described in FIG. 12 could be kept from twisting after installation by cementing it to a flat PVC plate 34 to create a conjoined flat surface as shown in FIG. 13. Holes 35 were drilled through both pieces simultaneously. This assembly could be mounted horizontally or vertically to a fixed support such as the outer skin of a water heater or a building structural member. One or more flexible securing means 12 were run through one or more slots 36 introduced between the pieces, and subsequently fastened about the expansion tank.

These manually fabricated examples demonstrated that other plastic versions of the support means could also be produced either by the means illustrated above or by more sophisticated industrial methods commonly known to the art including injection or compression molding and other methods, to yield a similar rigid or semirigid plastic bracket in a single manufacturing step without the need to cement together separate components. Other plastic materials such as PVC, polypropylene, nylon, ABS (acrylonitrile-butadiene-styrene), fiberglass-filled plastics, or other rigid or semiflexible plastics could be used. Alternatively, the assembly could be made either wholly or partially of metal or other rigid or semirigid material.

Figure 14A:
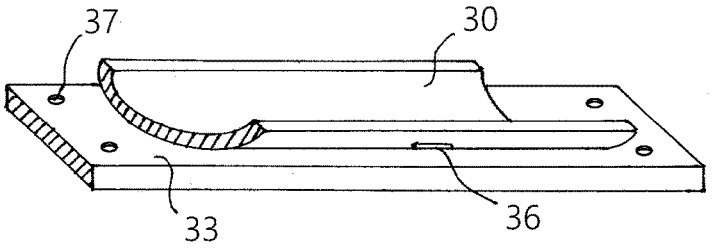
FIG. 14*a* is a perspective view of a ninth embodiment of a bracket for use in supporting the thermal expansion tank as shown in FIG. 1.

FIG. 14*a* demonstrates another version of the bracket described in FIG. 13, except the flat plate component 34 extends beyond the first curved surface 30 and contains the holes 37 needed to affix the assembly to the hot water heater or other fixed support with standard fastener means. Again, one or more flexible securing means 12 are run through one or more slots 36 located between the pieces and subsequently fastened about the expansion tank.

Figure 14B:
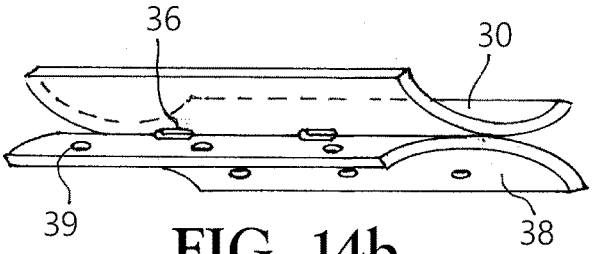
FIG. 14*b* is a perspective view of a tenth embodiment of a bracket for use in supporting the thermal expansion tank as shown in FIG. 1.

FIG. 14*b* describes another version of the same concept, except in this case the first curved surface 30 is mated to a second curved surface 38 that coincides with and is fastened to the periphery of the water heater using holes 39 and standard fastener means known to the art. As before, one or more flexible securing means 12 were run through slots 36 located between the pieces and subsequently fastened about the expansion tank.

As an option, the surfaces of either 14*a* or 14*b* could be fastened to each other by a central bolt or other single point of contact, whereby the first curved surface 30 component could be oriented in a vertical, horizontal, or any angled direction relative to the second curved surface 38 according to the needs of the installation and then locked in position by tightening the bolt, securing the bolt with nuts, use of a second bolt or screw, or other means known to the art.

In a further variation of the means described above in the descriptions for FIGS. 13 and 14*a*, FIG. 15 illustrates another version of the bracket whereby the flat plate component 34 is separated from first curved surface 30 by one or more perpendicular means or webs 40 of rigid material, either solid or with one or more openings as shown here. This thereby creates sufficient space between members 30 and 34 to not only allow room for flexible securing means 12 to secure the tank using one or more slots 36, but also permits insulation to be wrapped around the entire assembly in situations where there may be a temperature difference between the tank contents and the surrounding room, particularly where freezing conditions may be encountered. As previously described, flat plate component 34 is affixed directly to the water tank or other fixed support with standard fastener means such as screws, nails or the like through holes 37.

Figure 15:
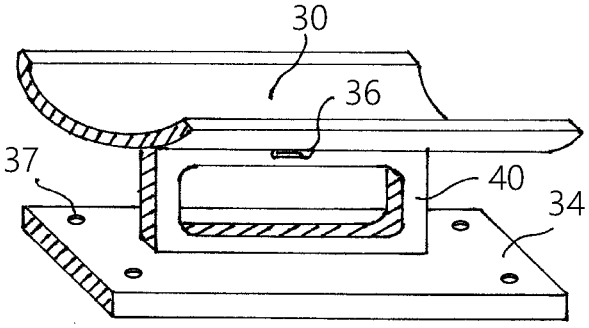
FIG. 15 is a perspective view of an eleventh embodiment of a bracket for use in supporting the thermal expansion tank as shown in FIG. 1.
Figure 16A:
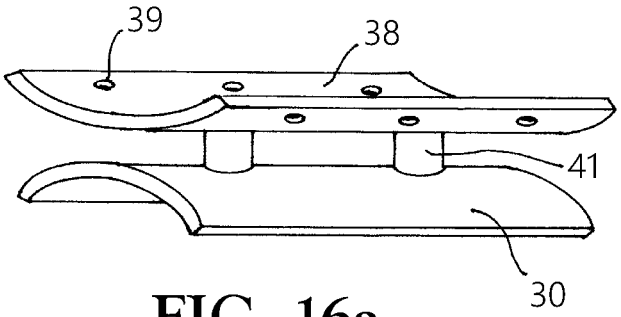
FIG. 16*a* is a perspective view of a twelfth embodiment of a bracket for use in supporting the thermal expansion tank as shown in FIG. 1.
Figure 16B:
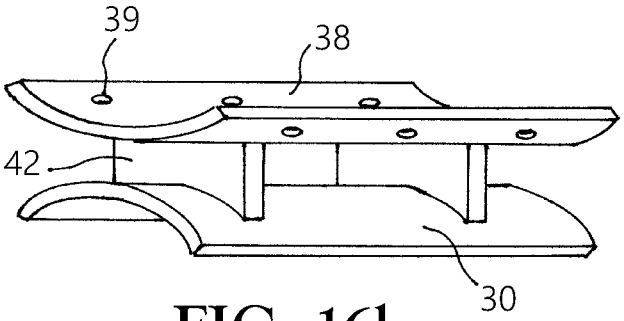
FIG. 16*b* is a perspective view of a thirteenth embodiment of a bracket for use in supporting the thermal expansion tank as shown in FIG. 1.

FIGS. 16*a* and 16*b* are two views that demonstrate still other embodiments of the means described by FIG. 15, whereby the perpendicular means separating first curved surface 30 from second curved surface 38 consists of one or more posts 41 or ribs 42 of rigid material, thus not only allowing space for the flexible securing means 12 to secure the tank but also permitting insulation to be wrapped more or less completely around the entire assembly without undue interference. Again, metal or other rigid material may be used in place of plastic for all or part of the bracket. Holes 39 are used to mount the bracket to the vertical outer skin of the water heater using standard fastener means.

Figure 17:
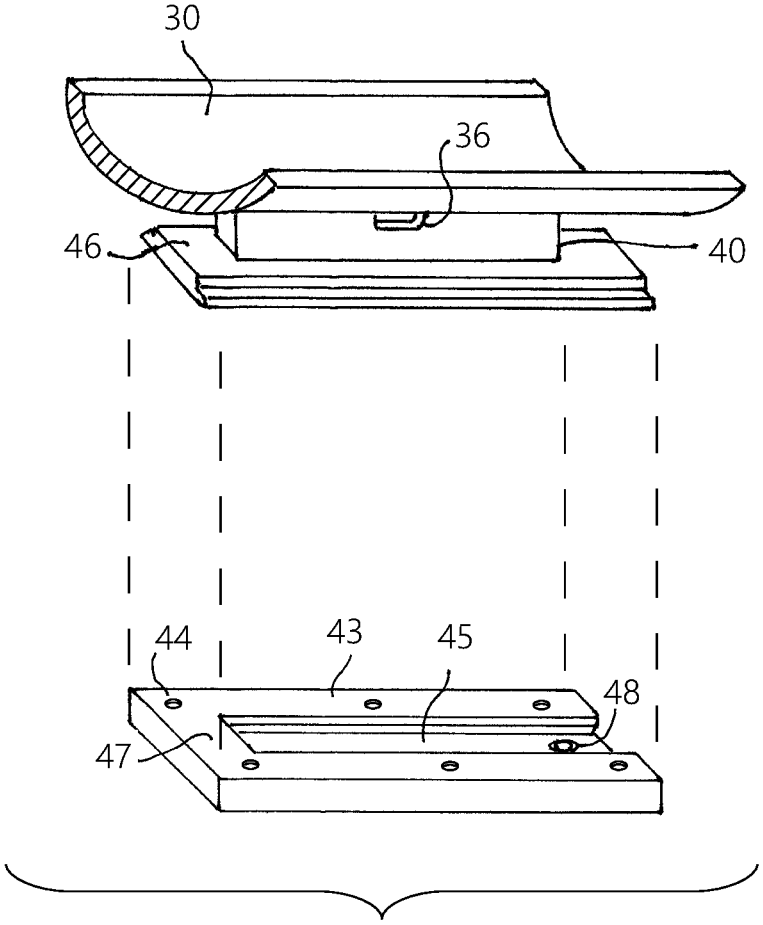
FIG. 17 is an exploded perspective view of a fourteenth embodiment of a bracket for use in supporting the thermal expansion tank as shown in FIG. 1.

FIG. 17 illustrates one typical example of a two-component bracket means. The first component (Part 17*a*) is a mounting base 43 comprising a strip or plate of rigid material such as metal or rigid plastic containing holes 44 for mounting to a fixed surface, such as the metal outer skin of a water heater or a building structural member, and forming or containing a receiving slot 45 that has its longitudinal edges mortised, slotted, curled inward or otherwise featuring recesses or projections that allow it to accept and hold a rigid member that is slid into it. (Alternatively, rather than the first component being a flat strip or plate, for attaching vertically to the periphery of a water heater it could instead be a slotted version of the second curved surface 38 shown in FIGS. 14*b*, 16*a* and 16*b*—that example is not illustrated in the Figures.) The second component (Part 17*b*) is a modified version of the bracket described in the discussion of FIGS. 15, utilizing first curved surface 30, a web, ribs or posts 40, one or more slots 36, and flexible securing means 12 to secure it to the tank; furthermore, permanently attached to web 40 is a sliding base 46 that incorporates longitudinal recesses or projections permitting it to mate snugly with and be retained by the recesses or projections of receiving slot 45. After the first component 43 has been mounted on the water heater or other fixed support using conventional fasteners known to the art, the second component 30 is slid into it. In this illustration the first curved surface 30 is separated by a slight distance from its own mounting base by a short web 40 although such separation is not mandatory. One end of the receiving slot 45 forms a stop 47 that prevents the bracket from sliding further through after reaching its desired position.

Optionally a hole or depression 48 may be provided in the base 43 to engage means to prevent subsequent dislodging of the second component 30 out of the first. Such means could include a spring-loaded detent, a spring-loaded ball, an integral spring created by a deforming some portion of sliding base 46 near its end, or other means commonly known to the art. An opposite arrangement could alternatively be used, where the hole or depression is located in the second component and the anti-dislodging means in the first, to preclude the bracket from involuntarily exiting the slot once in place. Alternately, simple means such as a screw driven through both of the pieces, or other such means may be employed.

As stated before in the discussion of FIG. 5, it will be understood that an option exists for each of the examples described by FIGS. 12 through 17 above, whereby one or more ends of flexible securing means 12 may be prefastened to curved surface 30 during manufacture by means comprising one or more rivets, adhesive, spot welding, brazing, crimping, stitching or other means commonly known to the art, to allow rapid installation of the entire assembly without needing to separately manipulate said fastening means on site as individual components during such installation, with only its (their) loose end(s) subsequently needing to be fastened with a clip, clamp, buckle or other means known to the art either to the opposite side of the bracket or to each other, as that particular manufactured version of the bracket dictates.

Although the present supporting apparatus for an expansion tank has been shown and described in considerable detail with respect to only a few exemplary embodiments thereof, it should be understood by those skilled in the art that we do not intend to limit the apparatus to the embodiments since various modifications, omissions and additions may be made to the disclosed embodiments without materially departing from the novel teachings and advantages, particularly in light of the foregoing teachings. Accordingly, we intend to cover all such modifications, omission, additions and equivalents as may be included within the spirit and scope of the supporting apparatus as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

I claim:

1. A tank supporting apparatus for supporting a thermal or hydronic expansion tank relative to a hot water heater, the tank having a central longitudinal axis and including a pipe nipple coaxial with the central longitudinal axis for fluid connection to a water piping system, the tank supporting apparatus comprising:

a rigid bracket adapted to be secured to the tank and to the hot water heater, the bracket comprising a base; and a pair of spaced end walls extending from the base, the end walls adapted for engaging and supporting the tank, wherein one of the end walls has an opening adapted for loosely receiving the pipe nipple for providing support for the tank at the pipe nipple, and the other of the end walls engages the tank past the midpoint of the length of the tank from the pipe nipple; and means for interconnecting the tank and the base for securing the tank to the bracket.

2. The tank supporting apparatus as recited in claim 1, wherein the tank is mounted to the water heater such that the central longitudinal axis extends horizontally.

3. The tank supporting apparatus as recited in claim 1, wherein the tank is mounted to the water heater such that the central longitudinal axis extends vertically.

4. The tank supporting apparatus as recited in claim 1, further comprising an attachment member adapted to be secured to the top of the water heater, and further comprising a support member extending upwardly from the attachment member for interconnecting the attachment member and the bracket, wherein the tank is supported above the water heater such that the tank and the water heater combination occupy a common vertical space.

5. The tank supporting apparatus as recited in claim 1, wherein the tank securing means comprises one or more straps, bands, belts, wires, ropes or cables of metal, plastic, fiber or other flexible material, and combinations thereof.

6. The tank supporting apparatus as recited in claim 1, wherein the tank securing means comprise an elongated flexible member, each end of the flexible member secured to the bracket such that the flexible member extends around the periphery of the tank.

7. The tank supporting apparatus as recited in claim 1, wherein a surface of the base of the bracket defines a concave engagement surface corresponding to the outer surface of the water heater at the point of attachment of the base.

8. The tank supporting apparatus as recited in claim 1, wherein the base of the bracket is flexible such that the base conforms with the outer surface of the water heater.

9. The tank supporting apparatus as recited in claim 1, wherein the other of the pair of end walls has a curved engagement surface adapted to conform to a portion of the peripheral surface of the tank at the point of support of the other of the pair of end walls.

10. The tank supporting apparatus as recited in claim 1, wherein the bracket further comprises partial side walls for structural reinforcement.

11. The tank supporting apparatus as recited in claim 10, wherein the side walls extedn between and interconnect the end wall.

12. The tank supporting apparatus as recited in claim 10, wherein the side walls define opposed slots for passing means for securing the tank to the base.

13. The tank supporting apparatus as recited in claim 1, wherein the base has a curved surface adapted to conform to a curved portion of the peripheral surface of the water heater.

* * * * *